US009347280B2

(12) United States Patent
Vanderford et al.

(10) Patent No.: US 9,347,280 B2
(45) Date of Patent: May 24, 2016

(54) ADJUSTABLE RISER SUSPENSION AND SEALING SYSTEM

(71) Applicant: Cameron International Corporation, Houston, TX (US)

(72) Inventors: Delbert Edwin Vanderford, Cypress, TX (US); Max Van Adrichem, Houston, TX (US)

( * ) Notice: Subject to any disclaimer, the term of this patent is extended or adjusted under 35 U.S.C. 154(b) by 0 days.

(21) Appl. No.: 14/486,953

(22) Filed: Sep. 15, 2014

(65) Prior Publication Data

US 2015/0000923 A1 Jan. 1, 2015

Related U.S. Application Data

(62) Division of application No. 13/102,676, filed on May 6, 2011, now Pat. No. 8,863,847.

(60) Provisional application No. 61/422,506, filed on Dec. 13, 2010.

(51) Int. Cl.
*E21B 19/00* (2006.01)

(52) U.S. Cl.
CPC ..... *E21B 19/004* (2013.01); *E21B 19/002* (2013.01)

(58) Field of Classification Search
CPC .... E21B 19/002; E21B 19/004; E21B 19/086
USPC ..... 166/367, 368, 341, 348, 345, 350, 351, 166/355, 359, 382, 387
See application file for complete search history.

(56) References Cited

U.S. PATENT DOCUMENTS

| | | | | |
|---|---|---|---|---|
| 3,926,457 | A | 12/1975 | Williams, Jr. | |
| 5,255,746 | A | 10/1993 | Bridges | |
| 5,671,812 | A | 9/1997 | Bridges | |
| 7,913,767 | B2 | 3/2011 | Larson et al. | |
| 8,196,666 | B2 | 6/2012 | Askestad | |
| 2002/0074124 | A1 | 6/2002 | Cunningham et al. | |
| 2002/0100596 | A1 * | 8/2002 | Nguyen | E21B 33/038 166/382 |
| 2004/0069493 | A1 * | 4/2004 | Borak, Jr. | 166/344 |
| 2005/0263294 | A1 * | 12/2005 | Braddick | 166/382 |
| 2006/0011347 | A1 * | 1/2006 | Reimert | 166/345 |
| 2011/0155382 | A1 | 6/2011 | Pallini et al. | |

OTHER PUBLICATIONS

PCT International Search Report and Written Opinion issued in corresponding application No. PCT/US2011/064582, dated Oct. 24, 2012, 3 pgs.
Written Opinion issued in corresponding Singapore patent application No. 201304422-7 dated Jan. 16, 2014, 5 pgs.

* cited by examiner

*Primary Examiner* — James G Sayre
(74) *Attorney, Agent, or Firm* — Chamberlain Hrdlicka

(57) ABSTRACT

An adjustable riser suspension system for suspending a riser under tension including a riser hanger, a mating sleeve rotationally coupled to the riser hanger, a ratchet-latch sleeve located inside the mating sleeve with an external profile configured to engage an internal profile of the mating sleeve and an internal profile configured to engage an externally threaded face of the riser. The riser hanger and mating sleeve are configured to move downward relative to the riser such that the mating sleeve fits over at least a portion of the riser, causing the ratchet-latch device to ratchet over the external threads of the riser. The mating sleeve is configured to rotate relative to the riser, causing the internal and external profiles of ratchet-latch device to lock the riser and the mating sleeve to prevent movement of the riser relative to the mating sleeve.

20 Claims, 8 Drawing Sheets

225
226

227
226
228
102

224a
223
218
226
224b
212
221
220a
222a
222b
220b 212
215
214
217
216

200
212
220a
220b
214
216
B
218
C
D

200
A
A

ADJUSTABLE RISER SUSPENSION AND SEALING SYSTEM

CROSS-REFERENCE TO RELATED APPLICATIONS

This application is a divisional of U.S. application Ser. No. 13/102,676, filed on May 6, 2011, and claims benefit of U.S. provisional application Ser. No. 61/422,506 filed Dec. 13, 2010, and entitled "Adjustable Riser Suspension and Sealing System," which both are hereby incorporated herein by reference in their entirety for all purposes.

STATEMENT REGARDING FEDERALLY SPONSORED RESEARCH OR DEVELOPMENT

Not Applicable.

BACKGROUND

A tension leg platform ("TLP") is a vertically moored floating structure used for offshore oil and gas production. The TLP is permanently moored by groups of tethers, called a tension leg, that eliminate virtually all vertical motion of the TLP. As a result of the minimal vertical motion of the TLP, the production wellhead may be located on deck instead of on the seafloor. The production wellhead connects to a subsea wellhead by one or more rigid risers.

The risers that connect the production wellhead to the subsea wellhead can be thousands of feet long and extremely heavy. To prevent the risers from buckling under their own weight or placing too much stress on the subsea wellhead, upward tension is applied, or the riser is lifted, to relieve a portion of the weight of the riser. The outermost riser, referred to herein as a casing, can be tensioned by hydraulic machines mounted to the TLP. An inner riser (e.g., a tie-back) is lifted, relative to the casing, to achieve a desired tension to relieve a portion of its weight from the subsea wellhead. However, the riser also needs to be shortened in length, relative to the casing, to compensate for the increase in length resulting from the increase in tension created by lifting the riser. Once the riser is shortened, the riser is then anchored to the production wellhead to maintain the desired tension.

In some solutions, the inner riser is shortened by clamping the riser while lifting under tension and removing an upper portion of the riser, for example by cutting. This solution is wasteful because material is removed from each successive riser after being lifted to a desired tension. In other solutions, the inner riser is shortened by tightening a threaded portion of the riser while lifting under tension. However, threading while under extreme axial loads is difficult. The threads bear the load of the riser while under tension and thus must be very robust and have very tight tolerances, both of which are very costly. Neither solution is desirable to shorten a riser after being lifted to achieve a desired tension.

SUMMARY OF DISCLOSED EMBODIMENTS

In accordance with various embodiments, an adjustable riser suspension system for suspending a riser under tension includes a riser hanger, a mating sleeve rotationally coupled to the riser hanger, a ratchet-latch sleeve located inside the mating sleeve with an external profile configured to engage an internal profile of the mating sleeve and an internal profile configured to engage an externally threaded face of the riser. The riser hanger and mating sleeve are configured to move downward relative to the riser such that the mating sleeve fits over at least a portion of the riser, causing the ratchet-latch device to ratchet over the external threads of the riser. The mating sleeve is configured to rotate relative to the riser, causing the internal and external profiles of ratchet-latch device to lock the riser and the mating sleeve to prevent movement of the riser relative to the mating sleeve.

In accordance with another embodiment, a running tool configured to manipulate an adjustable riser suspension system to suspend a riser under tension includes a work string configured to detachably couple to the riser, a piston affixed to the work string, an expansion cylinder disposed about the piston and configured to communicate with a riser hanger coupled to a mating sleeve, an annular slug affixed to the work string and comprising a hydraulic conduit, hydraulic sleeves disposed about the upper and lower portions of the annular slug that define hydraulic chambers, and a rotating sleeve disposed about the annular slug and having a helical groove on its interior surface. The hydraulic chambers are coupled by the hydraulic conduit and each of the hydraulic sleeves further comprises a guide pin on its exterior surface. The helical groove is engaged by the guide pins on the exterior surfaces of the hydraulic sleeves such that axial expansion of the hydraulic sleeves rotates the rotating sleeve.

In accordance with yet another embodiment, a method of installing a riser under tension in a well includes coupling the riser to a subsea wellhead and suspending the riser and a riser hanger on a work string inside an outer casing; urging the riser hanger downward relative to the riser, causing a mating sleeve to move over at least a portion of the riser; rotating the mating sleeve relative to the riser, causing the ratchet-latch device to bind to the riser, preventing movement of the riser relative to the riser hanger; and engaging metal-to-metal seals between the riser hanger and the riser together to seal the annulus between the riser and the mating sleeve. Moving the mating sleeve over the riser ratchets a ratchet-latch device inside the mating sleeve over a threaded external face of the riser.

BRIEF DESCRIPTION OF THE DRAWINGS

For a more detailed description of the embodiments, reference will now be made to the following accompanying drawings.

DETAILED DESCRIPTION OF THE DISCLOSED EMBODIMENTS

Figure 1:
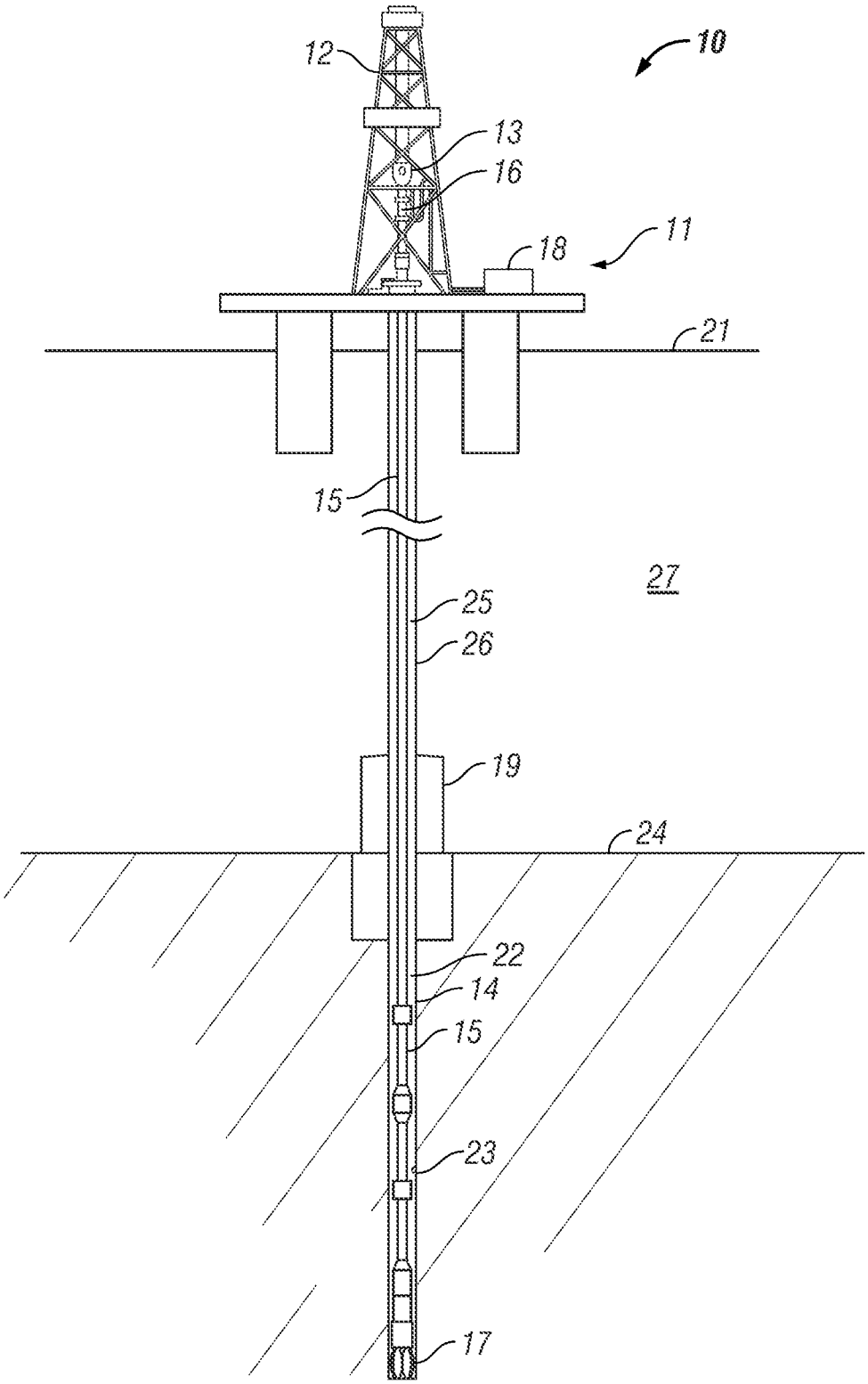
FIG. 1 shows an offshore sea-based drilling system in accordance with various embodiments.

In the drawings and description that follows, like parts are marked throughout the specification and drawings with the same reference numerals. The drawing figures are not necessarily to scale. Certain features of the invention may be shown exaggerated in scale or in somewhat schematic form and some details of conventional elements may not be shown in the interest of clarity and conciseness. The invention is subject to embodiments of different forms. Some specific embodiments are described in detail and are shown in the drawings, with the understanding that the disclosure is to be considered an exemplification of the principles of the invention, and is not intended to limit the invention to the illustrated and described embodiments. The different teachings of the embodiments discussed below may be employed separately or in any suitable combination to produce desired results. The terms "connect," "engage," "couple," "attach," or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Referring now to FIG. 1, a schematic view of an offshore drilling system 10 is shown. Drilling system 10 comprises an offshore drilling platform 11 equipped with a derrick 12 that supports a hoist 13. Drilling of oil and gas wells is carried out by a string of drill pipes connected together by "tool" joints 14 so as to form a drill string 15 extending subsea from platform 11. The hoist 13 suspends a kelly 16 used to lower the drill string 15. Connected to the lower end of the drill string 15 is a drill bit 17. The bit 17 is rotated by rotating the drill string 15 and/or a downhole motor (e.g., downhole mud motor). Drilling fluid, also referred to as drilling "mud", is pumped by mud recirculation equipment 18 (e.g., mud pumps, shakers, etc.) disposed on platform 11. The drilling mud is pumped at a relatively high pressure and volume through the drilling kelly 16 and down the drill string 15 to the drill bit 17. The drilling mud exits the drill bit 17 through nozzles or jets in face of the drill bit 17. The mud then returns to the platform 11 at the sea surface 21 via an annulus 22 between the drill string 15 and the borehole 23, through subsea wellhead 19 at the sea floor 24, and up an annulus 25 between the drill string 15 and a casing 26 extending through the sea 27 from the subsea wellhead 19 to the platform 11. At the sea surface 21, the drilling mud is cleaned and then recirculated by the recirculation equipment 18. The drilling mud is used to cool the drill bit 17, to carry cuttings from the base of the borehole to the platform 11, and to balance the hydrostatic pressure in the rock formations.

Figure 2A:
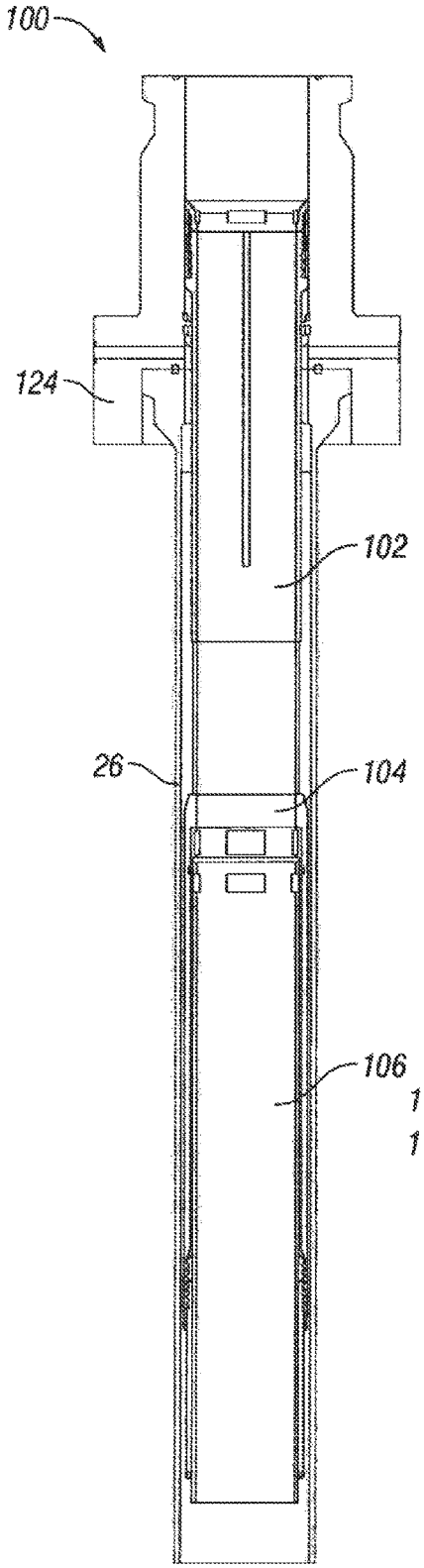
FIG. 2*a* shows an adjustable riser suspension system in accordance with various embodiments.

FIG. 2*a* shows an adjustable riser suspension system 100 in accordance with various embodiments. A casing 26, such as that shown in FIG. 1, is coupled to a surface wellhead 124 and may be held under tension by devices known to one skilled in the art to prevent buckling and reduce the load on the subsea wellhead 19. A tubular riser hanger 102 is coupled to a tubular mating sleeve 104 and both the riser hanger 102 and the mating sleeve 104 are disposed within the casing 26. The riser hanger 102, through the mating sleeve 104, is configured to engage a riser 106 and seal to the riser 106. When the riser hanger 102 and the mating sleeve 104 are engaged and sealed to the riser 106, the resulting tubular may serve as a conduit for production tubing for the production of oil or gas products.

Figure 2B:
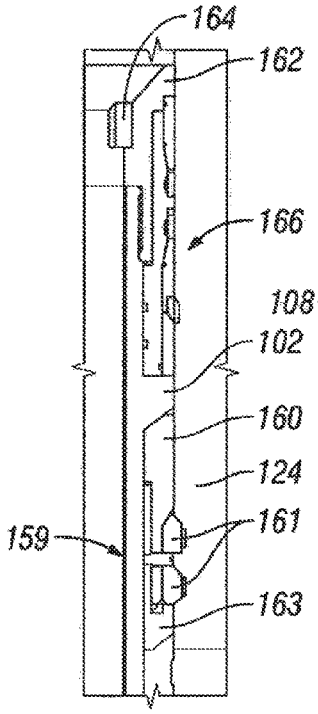
FIG. 2*b* shows an expanded view of an riser hanger support mechanism of the adjustable riser suspension system in accordance with various embodiments.

FIG. 2*b* shows an expanded view of the interface between the riser hanger 102 and the surface wellhead 124. A load shoulder assembly 159 includes a carrier ring 163, load segments 161 and an energizing ring 160. The load shoulder assembly 159 is disposed within the surface wellhead 124 to provide support for the riser hanger 102. The load shoulder assembly 159 is expanded in length during run in such that the bottom end of the energizing ring 160 is proximate the top end of the carrier ring 163 with the load segments 161 retracted to provide running clearance. The load segments 161 engage the surface wellhead 124 as a result of downward movement of the riser hanger 102, which cases the energizing ring 160 to move downward, causing the load segments 161 to expand outward.

A seal ring 162 is configured to thread onto the riser hanger 102 to set a seal pack subassembly 166. Notches 164 in the seal ring 162 may be engaged by a workstring, allowing rotation of the seal ring 162 resulting from rotation of the workstring. The seal ring 162 secures both the riser hanger 102 and the seal pack subassembly 166 to the surface wellhead 124 via a locking profile (not shown). Optionally, a dedicated lock ring may be used in conjunction with the seal ring 162 to secure both the riser hanger 102 and the seal pack subassembly 166 to the surface wellhead 124 via a locking profile (not shown).

Figure 2D:
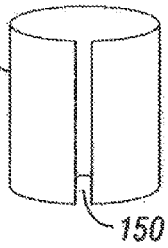
FIG. 2*d* shows an expanded view of a ratchet-latch mechanism of the adjustable riser suspension system in accordance with various embodiments.
Figure 2C:
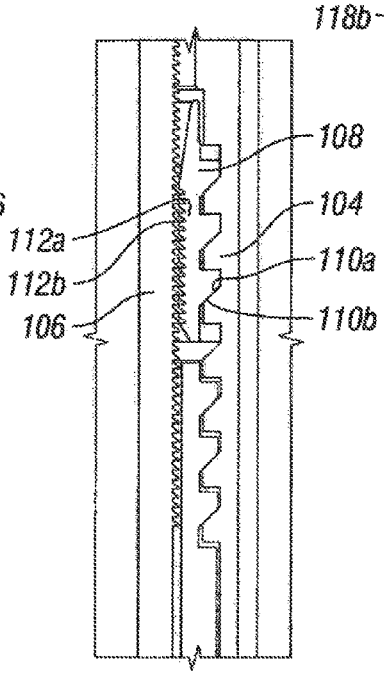
FIG. 2*c* shows an expanded view of a riser mating mechanism of the adjustable riser suspension system in accordance with various embodiments.

FIG. 2*c* shows an expanded view of the engagement between the mating sleeve 104 and the riser 106. A ratchet-latch 108 is disposed in an annulus 109 between the mating sleeve 104 and the riser 106. The ratchet-latch 108 has an external mating profile 110*a* that corresponds to a mating profile 110*b* of the mating sleeve 104 that enables the ratchet-latch 108 to be urged downward relative to the riser 106 in response to downward movement of the mating sleeve 104. The ratchet-latch 108 also has a threaded internal mating profile 112*a* that corresponds to a threaded external mating profile 112*b* of the riser 106 that enables the ratchet-latch 108 to ratchet downward relative to the riser 106 and thread onto the riser 106. Before the ratchet-latch 108 is urged downward relative to the riser 106, the adjustable riser suspension system is in an unlocked configuration. After the ratchet-latch 108 is urged downward relative to the riser 106 and the adjustable riser suspension system 100 has a desired length, the adjustable riser suspension system is in a locked configuration.

In some embodiments, the ratchet-latch 108 has a longitudinal slot 150 as shown in FIG. 2*d* that allows the ratchet-latch 108 to expand as necessary to provide sufficient clearance while ratcheting relative to the riser 106. Referring back to FIG. 2*c*, the camming surfaces of the mating profile 110*a*, 110*b* cause the longitudinal slot 150 of the ratchet-latch 108 to narrow or completely close in response to downward movement of the ratchet-latch 108 relative to the mating sleeve 104. The ratchet-latch 108 is designed such that the force required to induce a downward ratcheting motion is greater than the weight of the mating sleeve 104 and the riser hanger 102 (i.e., the ratchet-latch 108 does not ratchet relative to the riser 106 under the weight of the mating sleeve 104 and the riser hanger 102 alone).

Figure 2E:
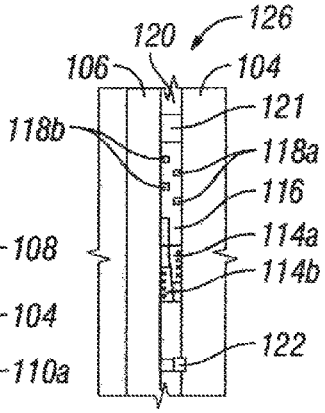
FIG. 2*e* shows an expanded view of a sealing mechanism of the adjustable riser suspension system in accordance with various embodiments.

FIG. 2*e* shows an expanded view of a seal subsystem 126 including seals 114*a*, 114*b* that seal the riser 106 to the mating sleeve 104. In some embodiments, the seals 114*a*, 114*b* engage each other in such a way that being axially urged together causes the seals 114*a*, 114*b* to radially expand and sealingly engage the portion to be sealed. In accordance with various embodiments, the bottom seal 114*b* abuts a stop 122, which prevents axial movement of the bottom seal 114*b* relative to the mating sleeve 104. The top seal 114*a* is configured to move relative to the mating sleeve 104 as a result of, for example, hydraulic or mechanical forces. The top seal 114*a* abuts an o-ring mount 116, comprising one or more o-rings 118*a*, 118*b* that sealingly engage the surfaces of the mating sleeve 104 and the riser 106, respectively. The o-ring mount 116 in turn abuts an annular sleeve of a backup ring 120. In some embodiments, a bearing ring 121 provides a low-friction interface between the o-ring mount 116 and the annular sleeve of the backup ring 120. One skilled in the art would understand that the top seal 114*a* may instead be fixed relative the mating sleeve 104 and the bottom seal 114*b* may be permitted to move relative to the mating sleeve 104 in a manner similar to that described above in relation to the top seal 114*a*.

As will be explained in further detail below, the adjustable riser suspension system 100 is configured to lift a riser and place it under a desired tension and lock the riser in place such that the desired tension is maintained. Furthermore, the adjustable riser suspension system 100 tensions and locks the riser using hydraulic pressure instead of threading tubulars together under extreme loads or removing excess portions of a tubular, providing significant advantages over prior art solutions to placing a riser under a desired tension.

Figures 3A, 3B, 3C, 3D, 3E, 3F:
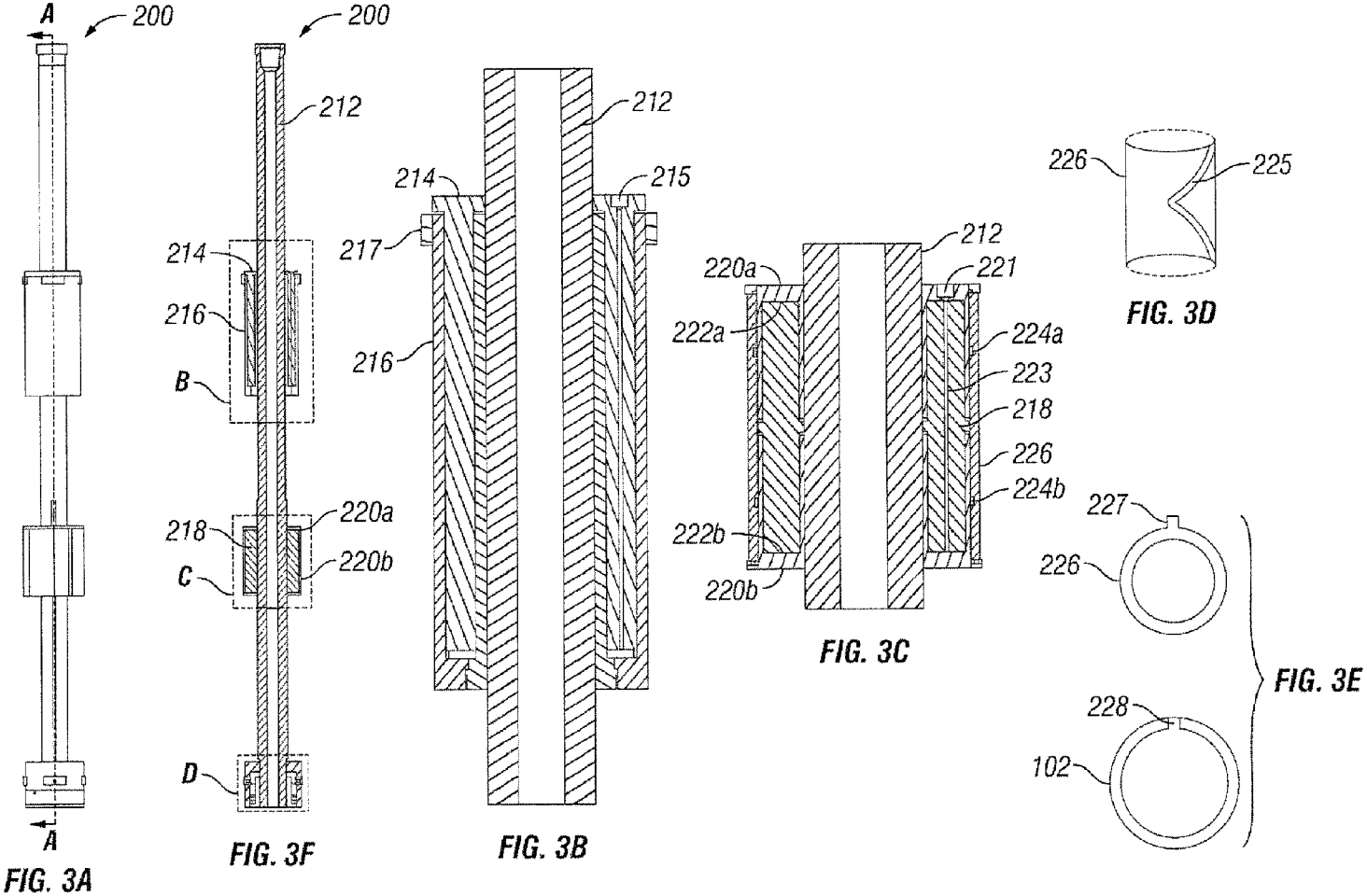
FIG. 3*a* shows a running tool in accordance with various embodiments.
FIG. 3*b* shows an expanded view of a portion of the running tool in accordance with various embodiments.
FIG. 3*c* shows an expanded view of another portion of the running tool in accordance with various embodiments.
FIG. 3*d* shows a cutaway view of a rotating sleeve with a helical groove in accordance with various embodiments.
FIG. 3*e* shows a view along the bore of a rotating sleeve and a liner hanger in accordance with various embodiments.
FIG. 3*f* shows a cross-sectional view of a running tool in accordance with various embodiments.

FIGS. 3*a* and 3*f* show a running tool 200 comprising workstring 212. An annular piston 214 is coupled to the workstring 212. The piston 214 may be affixed to the workstring 212 by welding, one or more fasteners, or other methods known to those skilled in the art. An expansion cylinder 216 surrounds the lower end of the piston 214. An annular slug 218 is also coupled to the workstring 212. The annular slug 218 may be affixed to the workstring 212 by welding, one or more fasteners, or other methods known to one skilled in the art. An upper hydraulic sleeve 220*a* is disposed about the upper end of the annular slug 218 and a lower hydraulic sleeve 220*b* is disposed about the lower end of the annular slug 218.

FIG. 3*b* shows the annular piston 214 and the expansion cylinder 216 in greater detail. The annular piston 214 comprises a hydraulic port 215, which allows hydraulic fluid to be pumped to the bottom of the annular piston 214, urging the expansion cylinder 216 downward relative to the annular piston 214. The expansion cylinder 216 comprises an annular shoulder 217 that is configured to mate with the riser hanger 102, such that motion of the expansion cylinder 216 relative to the piston 214 causes similar motion of the riser hanger 102 relative to the piston 214.

FIG. 3*c* shows the annular slug 218 and the hydraulic sleeves 220*a*, 220*b* in greater detail. The annular slug 218 is affixed to the workstring 212 such that there is sufficient clearance between at least a portion of the annular slug 218 and the work string 212 to provide clearance for hydraulic sleeves 220*a*, 220*b*. The area between the upper hydraulic sleeve 220*a* and the annular slug 218 defines an upper hydraulic chamber 222*a* and the area between the lower hydraulic sleeve 220*b* and the annular slug 218 similarly defines a lower hydraulic chamber 222*b*. The upper hydraulic sleeve 220*a* comprises a hydraulic port 221, which allows hydraulic fluid to be pumped into the upper hydraulic chamber 222*a*. Additionally, the annular slug comprises a hydraulic conduit 223 that balances the pressure between the upper hydraulic chamber 222*a* and the lower hydraulic chamber 222*b*. When hydraulic fluid is pumped into the upper hydraulic chamber 222*a*, the upper hydraulic sleeve 220*a* moves upward relative to the annular slug and the lower hydraulic sleeve 220*b* moves downward relative to the annular slug 218.

The exterior face of the upper hydraulic sleeve 220*a* comprises a guide pin 224*a*. Similarly, the exterior face of the lower hydraulic sleeve 220*b* comprises a guide pin 224*b*. The guide pins 224*a*, 224*b* are configured to mate with a helical groove 225 on the interior surface of a rotating sleeve 226 as shown in FIG. 3*d*. The axial motion of the hydraulic sleeves 220*a*, 220*b* (i.e., upward and downward, respectively) causes the guide pins 224*a*, 224*b* to move relative to the helical groove 225, which in turn causes the rotating sleeve 226 to rotate relative to the hydraulic sleeves 220*a*, 220*b*. Furthermore, the hydraulic sleeves 220*a*, 220*b* mate with the workstring 212 such that the hydraulic sleeves 220*a*, 220*b* can not rotate relative to the workstring 212. Thus, the rotating sleeve 226 is configured to rotate relative to both the hydraulic sleeves 220*a*, 220*b* and the workstring 212. FIG. 3*e* shows a view along the bore of the rotating sleeve 226 and the liner hanger 102. The rotating sleeve 226 comprises an exterior ridge 227 that is configured to mate with a corresponding slot 228 of the riser hanger 102, such that rotation of the rotating sleeve 226 relative to the workstring 212 induces a corresponding rotation of the riser hanger 102 relative to the workstring 212. As discussed above, the coupling between the riser 106 and the workstring 212 prevents rotation between the riser 106 and the workstring 212, so the riser hanger 102 also rotates relative to the riser 106.

Figure 4:
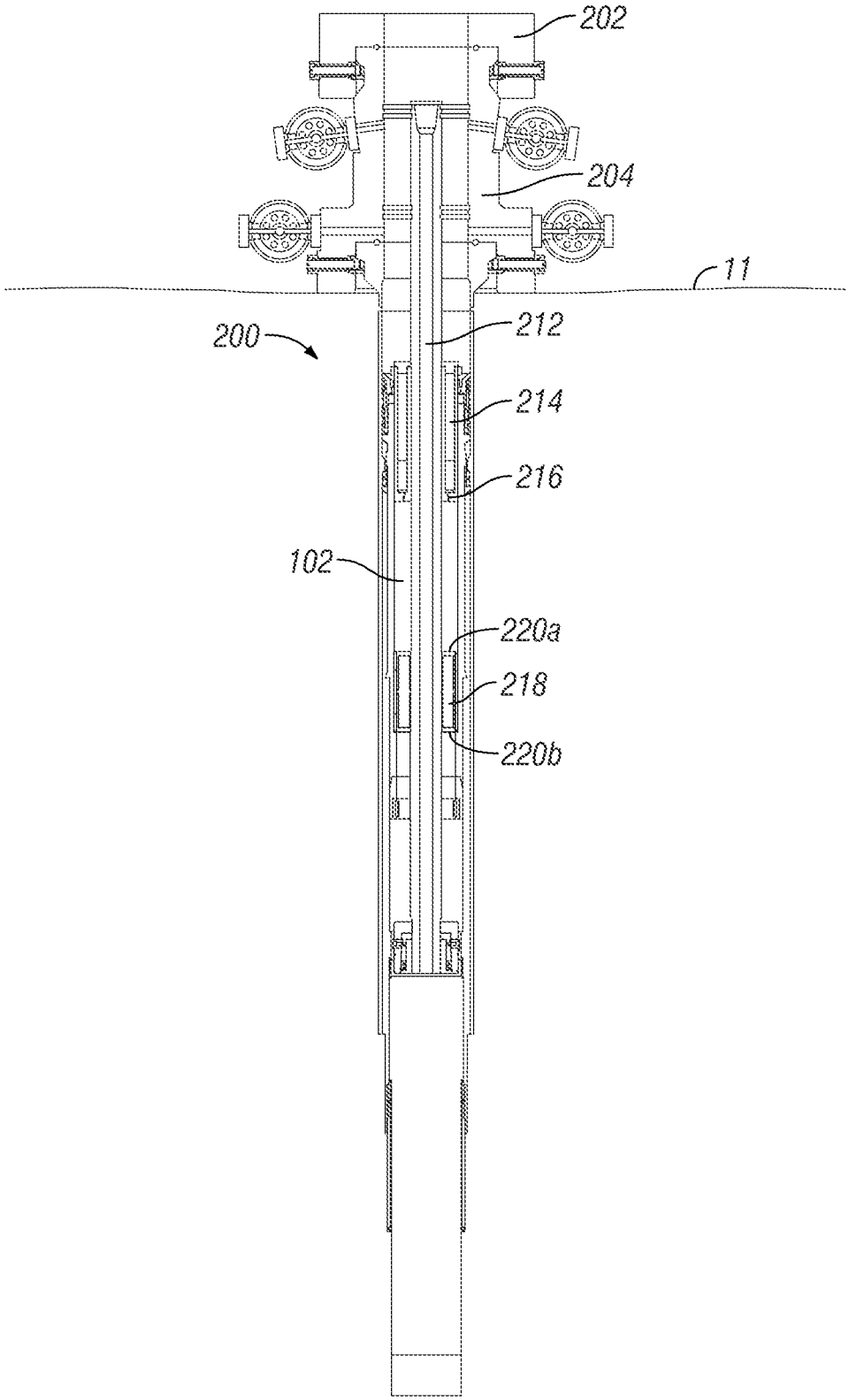
FIG. 4 shows the adjustable riser suspension system in an expanded configuration in accordance with various embodiments.

FIG. 4 shows the workstring 212 of the running tool 200 coupled to and supporting the riser 106. As explained above, the force required to urge the ratchet-latch 108 downward relative to the riser is grater than the weight of the riser hanger 102 and the mating sleeve 104, so the workstring 212 also supports the weight of the riser hanger 102 and the mating sleeve 104. The workstring 212 may be supported by, for example, a crane mounted to the drilling platform 11. A BOP adapter 202 and surface wellhead 204 are also mounted to the drilling platform 11. The surface wellhead 204 is configured to provide support for the casing 26 and multiple inner riser hangers, such as riser hanger 102. The riser 106 is coupled to the subsea wellhead 19 as shown in FIG. 1. The riser 106 may couple to the subsea wellhead 19, for example, by a bidirectional shoulder of the subsea wellhead 19. In FIG. 4, the riser 106 is ready to be lifted to a desired tension to prevent buckling of the riser 106 and reduce the load of the riser 106 on the subsea wellhead 19. The adjustable riser suspension system 100 is in the unlocked configuration.

Figure 5:
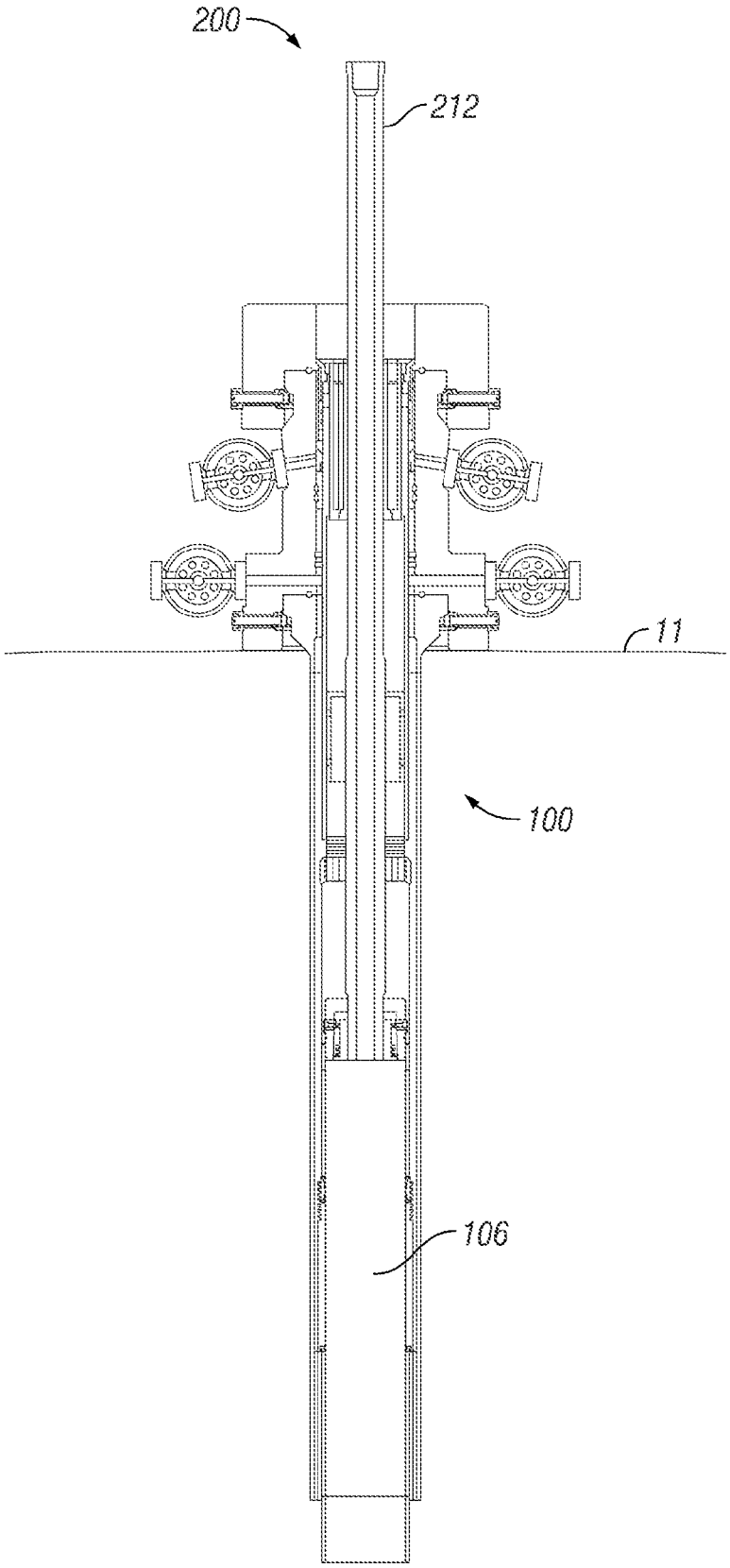
FIG. 5 shows the adjustable riser suspension system lifted to a desired tension in accordance with various embodiments.

FIG. 5 shows the running tool 200 after the workstring 212 has been lifted, causing the riser 106 to have a desired tension. As explained above, the workstring 212 may be lifted by a crane attached to the platform 11. The adjustable riser suspension system 100 is still in the unlocked configuration.

Figure 6:
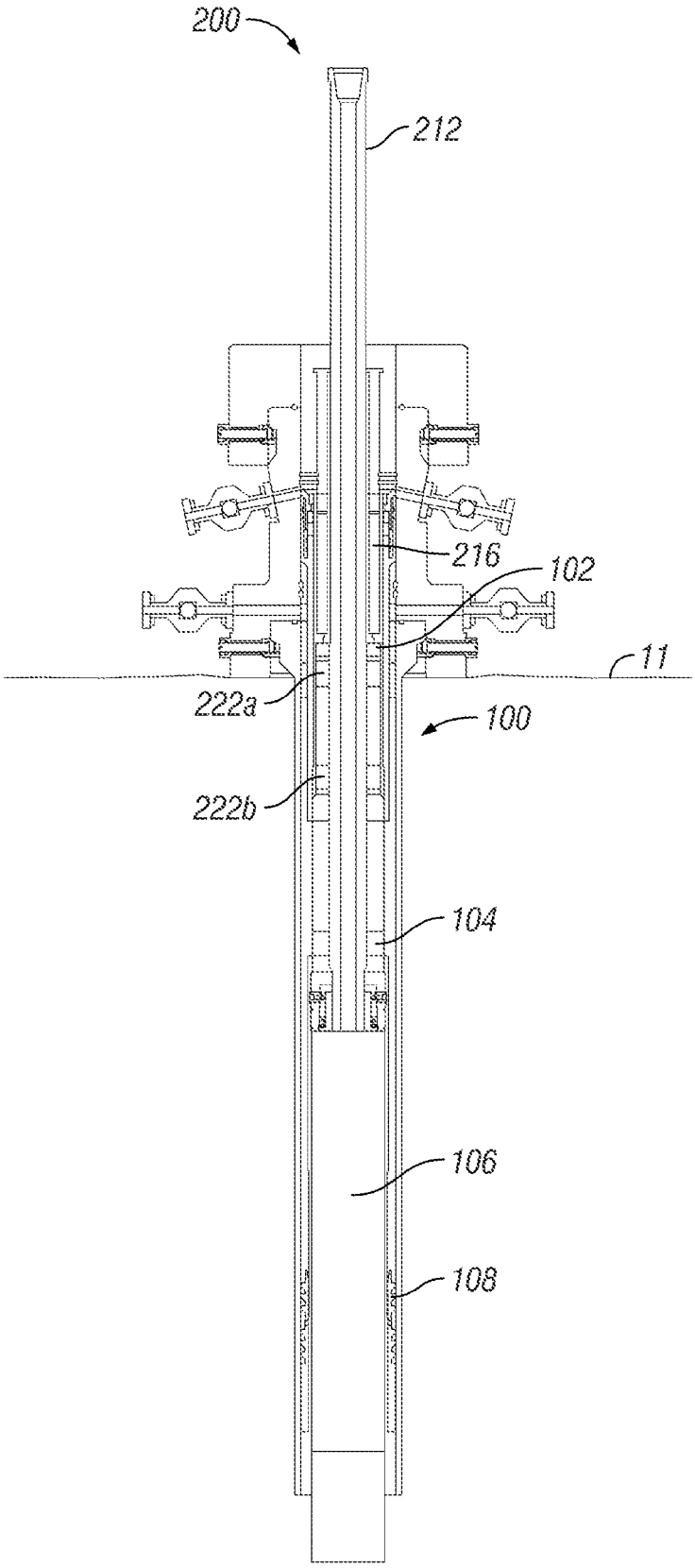
FIG. 6 shows the adjustable riser suspension system after being compacted to maintain the desired tension in accordance with various embodiments.

FIG. 6 shows the adjustable riser suspension system 100 and running tool 200 after the workstring 212 has been lifted, causing the riser 106 to have a desired tension. Hydraulic fluid is pumped into the expansion cylinder 216, causing the expansion cylinder 216 and the riser hanger 102 to move downward relative to the annular piston 214 and the workstring 212. The hydraulic force applied to the riser hanger 102 and the mating sleeve 104 is sufficient to cause the ratchet-latch 108 to ratchet downward relative to the riser 106.

Referring also to FIGS. 2*c* and 3*c*, hydraulic fluid is pumped into the upper hydraulic chamber 222*a*. The increase in pressure in the upper hydraulic chamber 222*a* is balanced in the lower hydraulic chamber 222*b* by way of the hydraulic conduit 223. This causes the hydraulic sleeves 220*a*, 220*b* to move upward and downward, respectively, relative to the annular slug 218. As explained above, the movement of the guide pins 224*a*, 224*b* relative to the helical groove on the interior of the rotating sleeve 226 causes the rotating sleeve 226 to rotate relative to the workstring 212, and thus causes the riser hanger 102 to rotate relative to the riser 106, which causes the threaded mating profile 112*a* of the ratchet-latch 108 to thread along the threaded mating profile 112*b* of the riser 106. The threading motion of the ratchet-latch 108 relative to the riser 106 binds up the ratchet-latch 108, preventing motion of the riser 106 relative to the mating sleeve 104 and the riser hanger 102. At this point, the riser 106 is shortened in length and held at a desired tension, and thus is in the locked configuration. The riser hanger 102 engages the surface wellhead 204 by methods known to those skilled in the art, and is configured to support the weight of the riser 106. The workstring 212 may be partially set down to test the support of the riser hanger 102, and subsequently the workstring 212 may be detached from the riser 106.

Figure 7A:
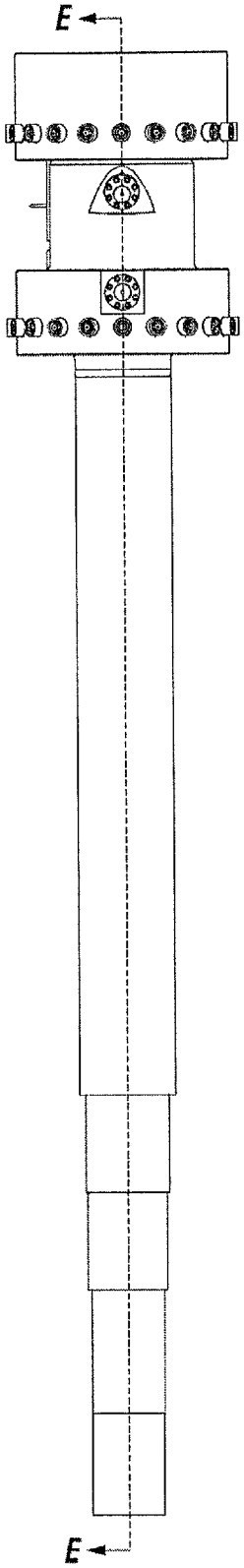
FIG. 7*a* shows a running tool in accordance with various embodiments.
Figure 7B:
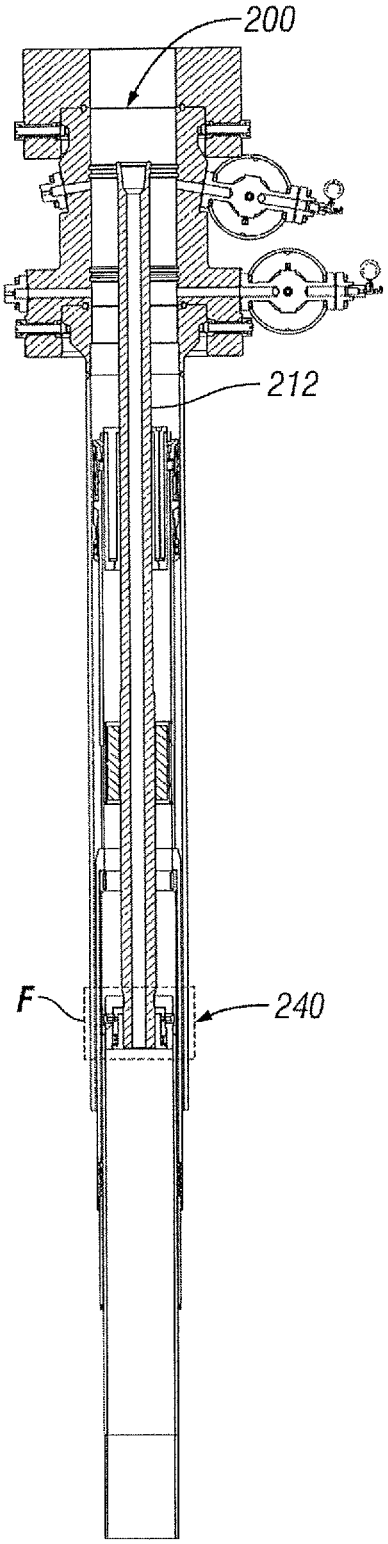
FIG. 7*b* shows a cross-sectional view of the running tool in accordance with various embodiments.
Figure 7C:
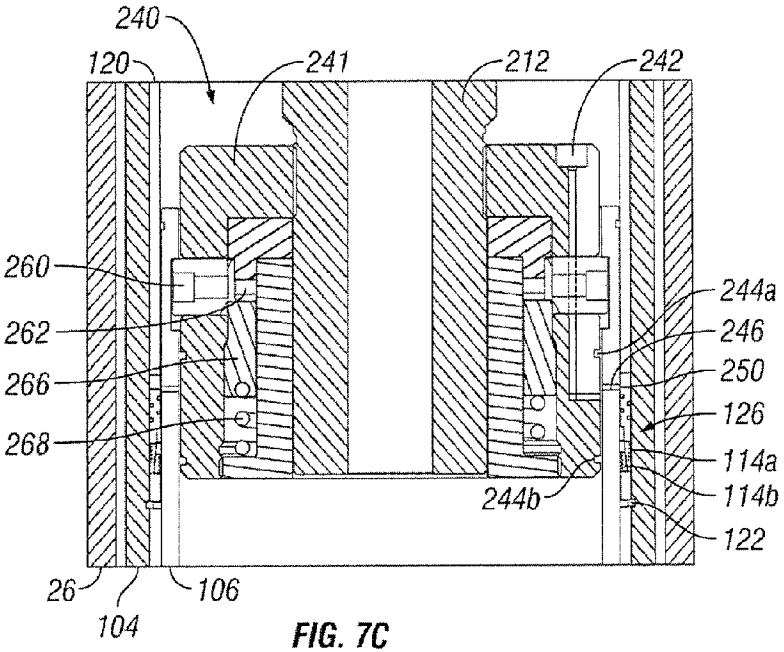
FIG. 7*c* shows an expanded view of the running tool in accordance with various embodiments.

After the adjustable riser suspension system 100 is in the locked configuration, the riser 106 is sealed to the mating sleeve 104 and, in turn, the riser hanger 102 to enable the riser to serve as a conduit for production tubing for the production of oil or gas products. FIGS. 7*a*, 7*b*, and 7*c* show expanded views of the workstring 212, the seal subsystem 126 and a hydraulic subsystem 240 for actuating the seals 114*a*, 114*b* of the seal subsystem 126. Hydraulic fluid is pumped through a hydraulic port 242 into an annulus between a hydraulic adapter 241 and the riser 106. The annulus is sealed with an upper o-ring 244*a* and a lower o-ring 244*b*. A hydraulic port 246 in the riser 106 couples the annulus to a chamber 250 above the o-ring mount 116 of the seal subsystem 126. The upper end of the chamber is sealed by the bearing ring 121, the backup ring 120, and a riser o-ring 248, so an increase in hydraulic pressure of the chamber 250 urges the o-ring mount 116 and the upper seal 114*a* downward towards the lower seal 114*b*. The contacting profile of the upper and lower seals 114*a*, 114*b* is angled, such that when the upper seal 114*a* is urged toward the lower seal 114*b*, the seals 114*a*, 114*b* expand radially (e.g., the upper seal 114*a* is pushed radially outward and the lower seal 114*b* is pushed radially inward). The seals 114*a*, 114*b* are designed such that this radial expansion causes the seals to bitingly engage both the riser 106 and the mating sleeve 104, thereby sealing the annulus between the riser 106 and the mating sleeve 104.

To supplement the hydraulic actuation of the seals 114*a*, 114*b*, a mechanical load is applied to the upper seal 114*a* to hold the upper seal 114*a* in contact with the lower seal 114*b*. Dogs 260 engage a profile in the riser 106, assuring proper hydraulic coupling to enable hydraulic actuation of the seal 114*a*. Dogs 260 are coupled to a spring 262 that is loaded to pull the dogs 260 radially inward. A dog shoulder 266 supported by a spring 268 prevents inward movement of the dogs 260. However, the dog shoulder 266 is configured to be urged downward (e.g., hydraulically), allowing the dog spring 262 to compress, pulling the dogs 260 radially inward and out of engagement with the riser 106.

As explained above, the workstring 212 no longer supports the riser 106, and thus the workstring 212 and the hydraulic subsystem 240 coupled to the workstring 212 may be lifted relative to the riser 106. Once the dogs 260 are above the top of the riser 106, the dog shoulder 266 is urged upward by relieving the hydraulic pressure on the dog shoulder 266 and activating the spring 268, forcing the dogs 260 outward into engagement with the backup ring 120. The exterior face of the backup ring 120 is threaded and configured to mate with a corresponding threaded profile in the mating sleeve 104. Rotation of the workstring 212 induces a corresponding rotation in the backup ring 120, causing the backup ring 120 to thread downward relative to the mating sleeve 104. The bearing ring 121 has a low coefficient of friction, such that the rotation of the backup ring 120 does not cause rotation of the o-ring mount 116 or the upper seal 114*a*. As the backup ring 120 is threaded downward relative to the mating sleeve 104, mechanical load is applied to the upper seal 114*a*, ensuring continued contact between the seals 114*a*, 114*b*.

The dogs 260 are then disengaged from the backup ring 120 in a manner similar to that described above with respect to the riser 106, and the workstring 212 is lifted such that the dogs 260 are aligned with the notches 164 described in FIG. 2*b*. The dogs 260 are forced outward into engagement with the notches 164 of the seal ring 162 in a manner similar to that described above. A rotational force is applied to the workstring 212 to cause the sealing ring 162 to thread downward on the riser hanger 102, causing the sealing pack subassembly 166 to sealingly engage the surface wellhead 124 and the riser hanger 102.

Figure 8:
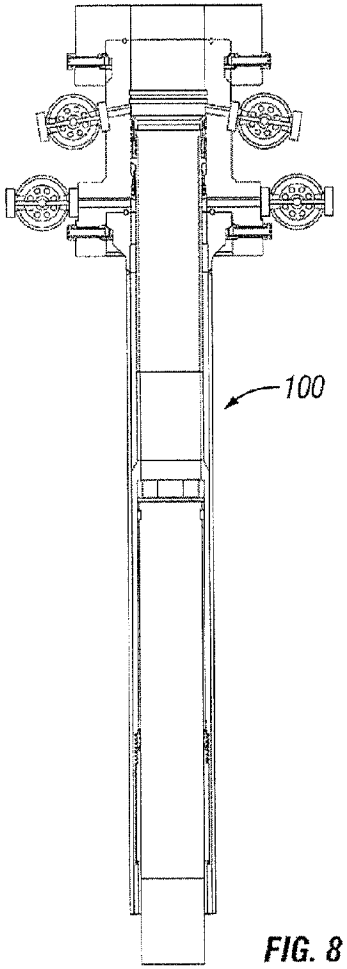
FIG. 8 shows the adjustable riser suspension system in a set configuration with the running tool removed in accordance with various embodiments.

The dogs 260 are then disengaged from the notches 164 of the seal ring 162 in a manner similar to that described above and the workstring 212 is removed. FIG. 8 shows the adjustable riser suspension system 100 in a fully adjusted and set configuration. As explained above, the riser hanger 102 supports the weight of the riser 106 under a desired tension to avoid buckling of the riser 106 and the adjustable riser suspension system 100 may thus be used, for example, for the production of oil and gas products from a subsea well.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A running tool configured to manipulate an adjustable riser suspension system to suspend a riser under tension, comprising:

a work string configured to detachably couple to the riser;

a piston affixed to the work string;

an expansion cylinder disposed about the piston, wherein the expansion cylinder is configured to communicate with a riser hanger coupled to a mating sleeve;

an annular element affixed to the work string, wherein the annular element comprises a hydraulic conduit;

hydraulic sleeves disposed about the upper and lower portions of the annular element that define hydraulic chambers, wherein the hydraulic chambers are coupled by the hydraulic conduit and wherein each of the hydraulic sleeves further comprises a guide pin on its exterior surface; and a rotating sleeve disposed about the annular element and having a helical groove on its interior surface, wherein the helical groove is engaged by the guide pins on the exterior surfaces of the hydraulic sleeves such that axial expansion of the hydraulic sleeves rotates the rotating sleeve.

2. The running tool of claim 1, wherein the expansion cylinder is configured to urge the riser hanger and the mating sleeve downward relative to the riser in response to an increase in pressure in the expansion cylinder, causing the mating sleeve to engage the riser.

3. The running tool of claim 1, wherein the upper and lower hydraulic sleeves are configured to expand axially away from the annular element in response to an increase in pressure in one of the hydraulic chambers.

4. The running tool of claim 1, wherein the rotating sleeve is configured to mate with the riser hanger to prevent rotation of the rotating sleeve relative to the riser hanger and wherein the upper and lower hydraulic sleeves are configured to mate with the work string to prevent rotation of the hydraulic sleeves relative to the work string.

5. The running tool of claim 4, wherein the riser hanger and mating sleeve are configured to rotate relative to the riser in response to rotation of the rotating sleeve.

6. A running tool configured to manipulate an adjustable riser suspension system to suspend a riser under tension, comprising:

a work string configured to detachably couple to the riser;

a piston affixed to the work string;

an expansion cylinder disposed about the piston and supported by the work string; and wherein the expansion cylinder comprises a shoulder that is configured to communicate with a riser hanger coupled to a mating sleeve.

7. The running tool of claim 6, wherein the expansion cylinder is configured to urge the riser hanger and the mating sleeve downward relative to the riser in response to an increase in pressure in the expansion cylinder, causing the mating sleeve to engage the riser.

8. The running tool of claim 6, further comprising:

an annular element affixed to the work string;

a hydraulic sleeve disposed about a portion of the annular element to define a hydraulic chamber, the hydraulic sleeve comprising one of a guide pin and a helical groove;

a rotating sleeve disposed about the annular element and comprising the other of the guide pin and the helical groove; and wherein the helical groove is engaged by the guide pin such that axial expansion of the hydraulic sleeve rotates the rotating sleeve.

9. The running tool of claim 8, wherein the hydraulic sleeve comprises the guide pin on an exterior surface of the hydraulic sleeve, and wherein the rotating sleeve comprising the helical groove on an interior surface of the rotating sleeve.

10. The running tool of claim 8, wherein the annular element comprises a hydraulic conduit, wherein the hydraulic chamber comprises a first hydraulic chamber and a second hydraulic chamber, and wherein the hydraulic sleeve comprises a first hydraulic sleeve and a second hydraulic sleeve, each disposed about opposite end portions of the annular element to each define the first and second hydraulic chambers, and wherein the first and second hydraulic chambers are coupled by the hydraulic conduit.

11. The running tool of claim 10, wherein the first and second hydraulic sleeves are configured to expand axially away from the annular element in response to an increase in pressure in one of the hydraulic chambers.

12. The running tool of claim 8, wherein the rotating sleeve is configured to mate with the riser hanger to prevent rotation of the rotating sleeve relative to the riser hanger and wherein the hydraulic sleeve is configured to mate with the work string to prevent rotation of the hydraulic sleeve relative to the work string.

13. The running tool of claim 8, wherein the riser hanger and mating sleeve are configured to rotate relative to the riser in response to rotation of the rotating sleeve.

14. A running tool configured to manipulate an adjustable riser suspension system to suspend a riser under tension, comprising:

a work string configured to detachably couple to the riser;

an annular element affixed to the work string;

a hydraulic sleeve disposed about a portion of the annular element to define a hydraulic chamber, the hydraulic sleeve comprising one of a guide pin and a helical groove;

a rotating sleeve disposed about the annular element and comprising the other of the guide pin and the helical groove; and wherein the helical groove is engaged by the guide pin such that axial expansion of the hydraulic sleeve rotates the rotating sleeve.

15. The running tool of claim 14, wherein the hydraulic sleeve comprises the guide pin on an exterior surface of the hydraulic sleeve, and wherein the rotating sleeve comprising the helical groove on an interior surface of the rotating sleeve.

16. The running tool of claim 14, wherein:

the annular element comprises a hydraulic conduit;

the hydraulic chamber comprises a first hydraulic chamber and a second hydraulic chamber;

the hydraulic sleeve comprises a first hydraulic sleeve and a second hydraulic sleeve, each disposed about opposite end portions of the annular element to each define the first and second hydraulic chambers; and the first and second hydraulic chambers are coupled by the hydraulic conduit.

17. The running tool of claim 14, further comprising:

a piston affixed to the work string;

an expansion cylinder disposed about the piston; and wherein the expansion cylinder is configured to communicate with a riser hanger coupled to a mating sleeve.

18. The running tool of claim 17, wherein the expansion cylinder is configured to urge the riser hanger and the mating sleeve downward relative to the riser in response to an increase in pressure in the expansion cylinder, causing the mating sleeve to engage the riser.

19. The running tool of claim 17, wherein the rotating sleeve is configured to mate with the riser hanger to prevent rotation of the rotating sleeve relative to the riser hanger and wherein the hydraulic sleeve is configured to mate with the work string to prevent rotation of the hydraulic sleeve relative to the work string.

20. The running tool of claim 17, wherein the riser hanger and mating sleeve are configured to rotate relative to the riser in response to rotation of the rotating sleeve.

* * * * *